US005501606A

United States Patent [19]

Oda et al.

[11] Patent Number: 5,501,606

[45] Date of Patent: Mar. 26, 1996

[54] ELECTRICAL CONNECTOR HAVING CONTACT GUIDE MEMBER

[75] Inventors: Kenzo Oda, Hadano; Akira Nagamine, Kawasaki; Shinji Amemiya, Yokohama, all of Japan

[73] Assignee: The Whitaker Corporation, Wilmington, Del.

[21] Appl. No.: 219,597

[22] Filed: Mar. 29, 1994

[30] Foreign Application Priority Data

Apr. 1, 1993 [JP] Japan ..... 5-016151 U
Feb. 3, 1994 [JP] Japan ..... 6-031912

[51] Int. Cl.[6] ..... H01R 13/44

[52] U.S. Cl. ..... 439/140; 439/141; 439/357

[58] Field of Search ..... 439/586, 374, 439/378, 380, 140, 141, 357, 353, 350, 358

[56] References Cited

U.S. PATENT DOCUMENTS 4,274,693 6/1981 Cobaugh et al. ..... 439/374
4,593,960 6/1986 Millhimes et al. ..... 439/140
4,797,116 1/1989 Isohata et al. ..... 439/141
4,832,613 5/1989 Tsukakoshi ..... 439/141
5,273,449 12/1993 Mattis et al. ..... 439/141 X
5,332,396 7/1994 Kaneko et al. ..... 439/141

*Primary Examiner*—Larry I. Schwartz
*Assistant Examiner*—Daniel Wittels
*Attorney, Agent, or Firm*—Mary K. VanAtten

[57] ABSTRACT

A connector 10, 30' has a guide member 70, 60' movably latched in its housing 12, 40'. The guide member 70, 60' is used to guide and align contact portions of male contacts. The guide member 70, 60' has a plate 72 formed with a large number of through-holes 84 to pass the male contacts therethrough. Preferably, the guide member 70 is formed with side plates 78 at both sides of the plate 72 perpendicular thereto. Latching arms 92, 94, 96 are stemmed from the free ends of the side plates 78 and extend in the opposite direction, thereby minimizing the apparent length of the latching arms 92, 94, 96 which engage with respective projections 100, 102, 104 on the inner wall of the connector housing 12.

14 Claims, 18 Drawing Sheets

(PRIOR ART) FIG. 16

ELECTRICAL CONNECTOR HAVING CONTACT GUIDE MEMBER

FIELD OF THE INVENTION

The present invention relates to an electrical connector, more specifically to such a connector provided with a guide member to protect bending of male contacts.

BACKGROUND OF THE INVENTION

Connectors provided with guide members to protect bending of male contacts disposed in their housings are known. One example of such connectors is disclosed in, for example, Japanese UM Publication No. 63(1988)-116985 and is described hereunder by reference to FIGS. 16 and 17.

Illustrated in FIG. 16 is a longitudinal cross sectional view of female type and male type connectors before mating. On the other hand, FIG. 17 shows a longitudinal cross sectional view of the both connectors in the mated condition.

Disposed in a housing 212 of the female type connector 210 are a plurality of male contacts 214. A leading end 214*a* of each male contact 214 extends through a respective through-hole in a guide member 216 which is temporarily retained within the housing 212 by means of a projection 212*a* formed in the housing 212 latchingly received in a recess 216*a* in the guide member 216. When the female type connector 210 and the male type connector 220 are mated with each other, the guide member 216 moves to the rear end portion of the male contacts 214 by being pushed by the male type connector 220, thereby establishing the engagement between the male contacts 214 and respective receptacle or female contacts 222 as best shows in FIG. 17.

As mentioned above, insertion of the leading ends of the male contacts in the respective through holes in the guide member of the connector provided with such guide member effectively protects bending of the male contacts. On the other hand, as both the male type and female type connectors are mated, the guide member moves toward the rear end portions of the male contacts by being pushed by the male type connector.

There are circumstances where both the connectors 210, 220 are to be mated and unmated more than once. If the guide member 216 remains at the rear end portion after unmating the connectors, the male contacts or contact pins 214 are unprotected and thus may be bent by external force applied thereto before being mated again with the matable connector. In order to solve this problem, the prior art connector is provided with additional means as best shown in FIG. 18.

A latching arm 234 is provided with a male type connector 220 to engage with an engaging hole 230 in an end wall 218 of a guide member 216 when both connectors 210, 220 are mated. In unmating the male type connector 220, the guide member 216 is pulled back to its initial position as best shown in FIG. 18(A). The latching arm 234 abuts against a hold-down plate 232 extending through a guide plate portion 217 when both the connectors are mated, thereby establishing assured engagement with the engaging hole 230. The hold-down plate 232, the latching arm 234 and the engaging hole 230 cooperate with one another so that the guide member 216 remains at the initial location to effectively protect the contact pins 214 as long as the female type connector 210 is unmated with the matable connector.

It is typical that the guide member is temporarily retained in the housing with a weak force so that the leading ends of the male contacts are protected from being bent or maintain proper alignment until both male type and female type connectors are brought into mating relationship. The reason is that if the retention force is too strong, both connectors are hard to be mated with each other. As a result, in the conventional connectors with guide members had a problem that the guide members accidentally move from the latched front position toward the rear end portion of the male contacts by vibration of the connectors are accidentally hit during transportation of the connectors.

Also, the use of the hold-down plate 212 and the latching arm 234 of the prior art connectors occupy a certain space in the housing, thereby limiting high density positioning of the contacts. Additionally, the latching arm 234 extends long enough from the guide member 220 that it may be broken or otherwise damaged when it is handled individually or the connectors are left unmated.

SUMMARY OF THE INVENTION

It is therefore an object of the present invention that the guide member is firmly retained in position to prevent accidental movement by vibration or other force until the male type and female type connectors are mated. When mating the connectors, on the other hand, the temporary retention of the guide member is easily released for smooth mating of the connectors.

It is another object of the present invention to provide a high contact density connector having a rugged guide member for male contacts which are returned to its initial position when unmated.

The connector provided with guide member according to the present invention comprises a first connector having a first housing and male contacts disposed in the first housing and extending in the mating direction; a second connector having a second housing to mate with the first housing; and a guide member having a plurality of through-holes to pass the male contacts therethrough and being pushed to the rear end of the male contacts by the second connector when mating the first and second connectors; wherein the first housing has projections on the inner wall at the forward position than the leading ends of the male contacts; the guide member have legs formed with resilient spring portions extending in the mating direction and hook portions to inhibit movement of the guide member to the rear end portions of the male contacts by engagement with the projections; and the second housing has pushing projections to unlock the engagement with the legs and the projections by pushing the hook portions to deflect the spring portions when mating the first and second housing.

The connector according to another aspect of the present invention contains a female type insulating housing having a recess to receive a male type connector therein and a guide member moving in the recess along the mating direction of the male type connector and having a guide plate portion formed with a plurality of openings to guide contact portions of the male contacts extending in the recess and latching arms to engage with the male type connector, wherein the guide member has side plates extending in the mating direction from the edge portion of the guide plate portion and the latching arms extend in the opposite direction from the free ends of the side plates to the direction to which the side plates extend.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
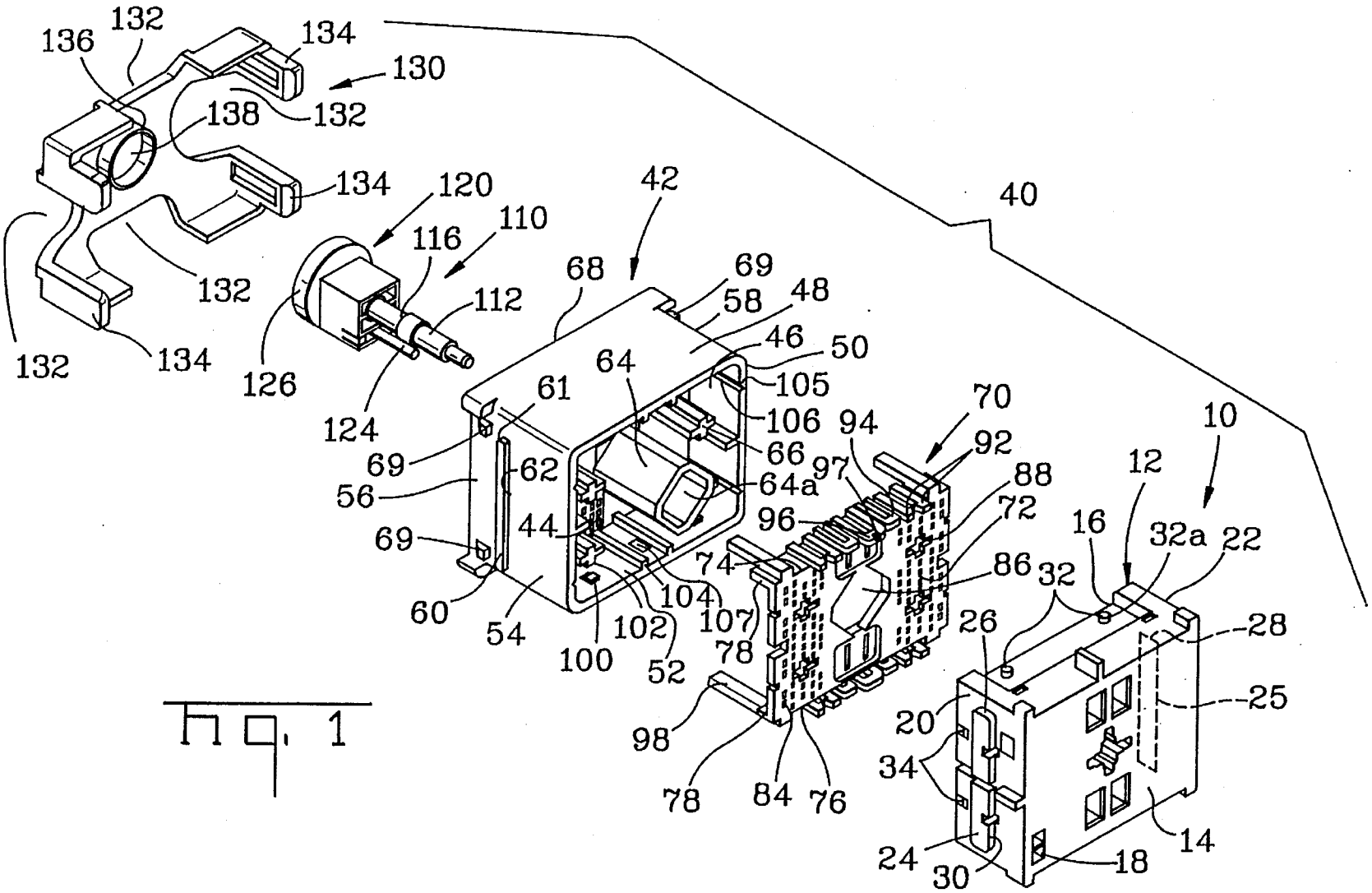
FIG. 1 is an exploded perspective view of one embodiment of the connector according to the present invention.

Now, preferred embodiments of the present invention will be described in detail by reference to the accompanying drawings, especially FIGS. 1 through 15. Illustrated in FIG. 1 is an exploded perspective view of one embodiment of the connector according to the present invention. FIG. 2A through D are different views of the guide member used in the connector in FIG. 1. FIG. 3 is a cross sectional view of the guide member in FIG. 2.

In FIG. 1, the electrical connector comprises a male type connector 10 and a female type connector 40 to be mated with each other by using a nut (not shown) mounted in the male type connector 10 and a bolt 110 in the female type connector 40. The male type connector 10 has a generally rectangular insulting housing 12 provided with a large number of cavities 18 (only some of the cavities are shown in FIG. 1) extending from its contact insertion face 14 to the opposite mating face 16 to receive female contacts (not shown) therein. Inserted into the insulating housing 12 from the opposed side surfaces 20, 22 are locking members 24, 25 to prevent the female contacts from being pulled out. The female contacts are retained by conventional housing lances (not shown) formed in the cavities 18 and also double locked by the locking member 24. One corner of the locking member 24 is formed with a sloped surface 26. Similarly, a sloped surface 28 is formed in another locking member 25 at the mirror image position as shown by the dotted line. The sloped surfaces 26, 28 of the two locking members 24, 25 at different positions provide polarization. In this way, the locking member 24 cannot be inserted into the locking member insertion hole (not shown) in the opposite side surface 22 and similarly, the other locking member 25 cannot be inserted into the locking member insertion hole 30 in the side surface 22. It is to be noted that the polarization may be achieved not only by the sloped surface but also by other shapes such as an L-shaped hole, an arcuate surface, etc.

The female type connector 40 has a female insulating housing 42 to accommodate tab (male) contacts (not shown) in a large number of cavities 44. The insulating housing 42 is provided with a mating recess 46 defined by four sidewalls 48, 50, 52 and 54. The opposed side surfaces 56, 58 of the insulating housing 42 are formed with locking member insertion holes 62 (only one hole is shown) for receiving the locking members 60 (only one is shown) for protecting pull out of the tab contacts. The locking member 60 is formed with a sloped surface 61 similar to the locking member 24. Note that the locking member 60 has a different dimension from the locking member 24, thereby preventing an assembly error by an operator because the locking member 60 does not fit into the locking member insertion hole 30 in the male type connector housing 12 even if attempted by the operator. The same is true with the locking member 24 which does not fit even if inserted into the locking member insertion hole 62 in the female type connector housing 42. Since the connectors 10, 40 are symmetrical, it is difficult to identify the direction or orientation of mating. However, they may be identified by color coding. For example, the locking member 24, 60 are black while the locking members opposite to the locking members 24, 60 are yellow.

Extending from the bottom surface thereof in the recess 46 of the female type connector housing 42 are a sleeve member 64 and a plurality of posts 66 (four posts in the shown embodiment). The sleeve member 64 is to cover and protect screw portion 112 of bolt 110. Also, the sleeve member 64 and the posts 66 are longer than contact portions (not shown) of the tab contacts extending from the bottom surface of the recess 46, thereby protecting the contact portions of the tab contacts from rocking (or "kojiri") of the male type connector 10.

A guide member 70 is accommodated in the recess 46 in the insulating housing 42 in such a manner to slide along the sidewalls 46, 48, 50, 52 defining the recess 46. As best shown in FIGS. 1 through 3, the guide member 70 has a generally rectangular guide plate 72 and opposed side plates 78 extending from the opposed two edges 74, 76 generally perpendicular to the guide plate portion 72. The guide plate portion 72 is formed with a large number of holes 84 (only some of the holes are shown in FIG. 1) extending from the front face 80 to the rear face 82 at the corresponding number and position to the cavities 44 in the insulating housing 42. The through-holes 84 act to support and protect the contact portions (not shown) of the tab contacts from deformation or breaking in the conventional manner. Further, the guide plate portion 72 is formed with sleeve insertion hole 86 and post insertion holes 88. At substantially the center in the rear face 82 of the guide plate portion 72, there are formed ribs 90 extending vertically in FIG. 2A between the two edges 74, 76. The ribs 90 across the guide plate portion 72 are to provide mechanical strength of the guide plate portion 72 and to reduce deflection or twist thereof.

Figure 2A:
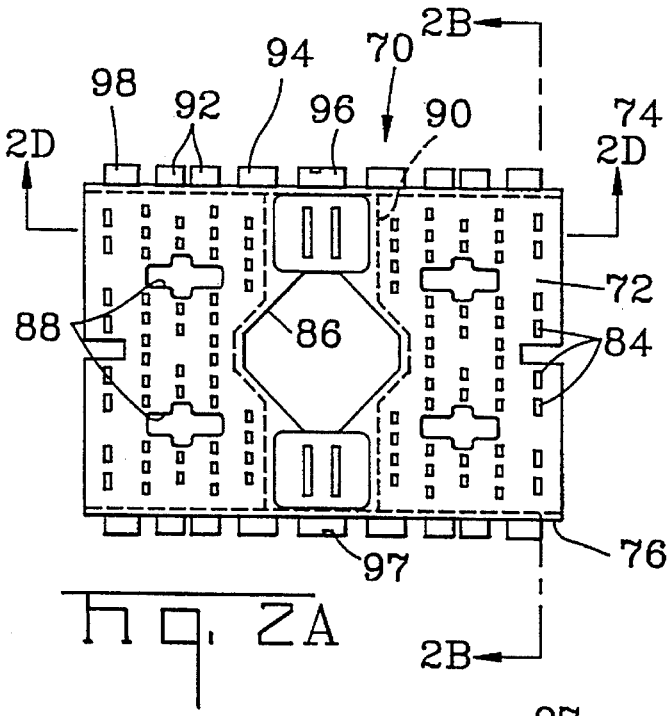
FIGS. 2A through 2D are a plan view, a cross sectional view along the line B—B in FIG. 2A, a front view, and a cross sectional view along the line D—D in FIG. 2A, respectively.
Figure 2B:
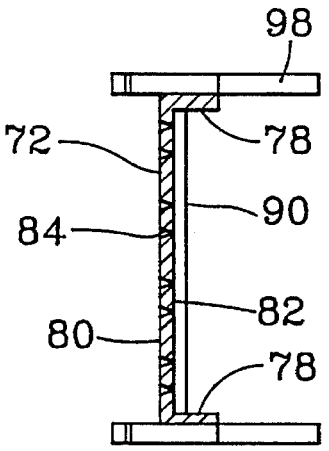
Figure 2C:
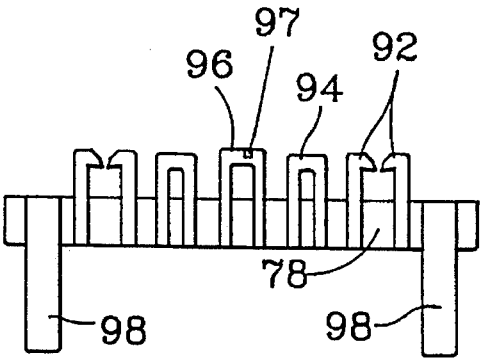
Figure 2D:
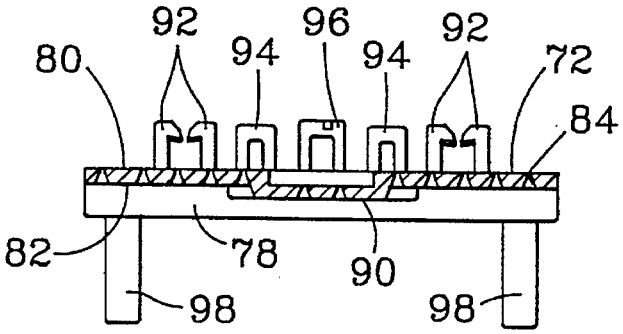
Figure 3:
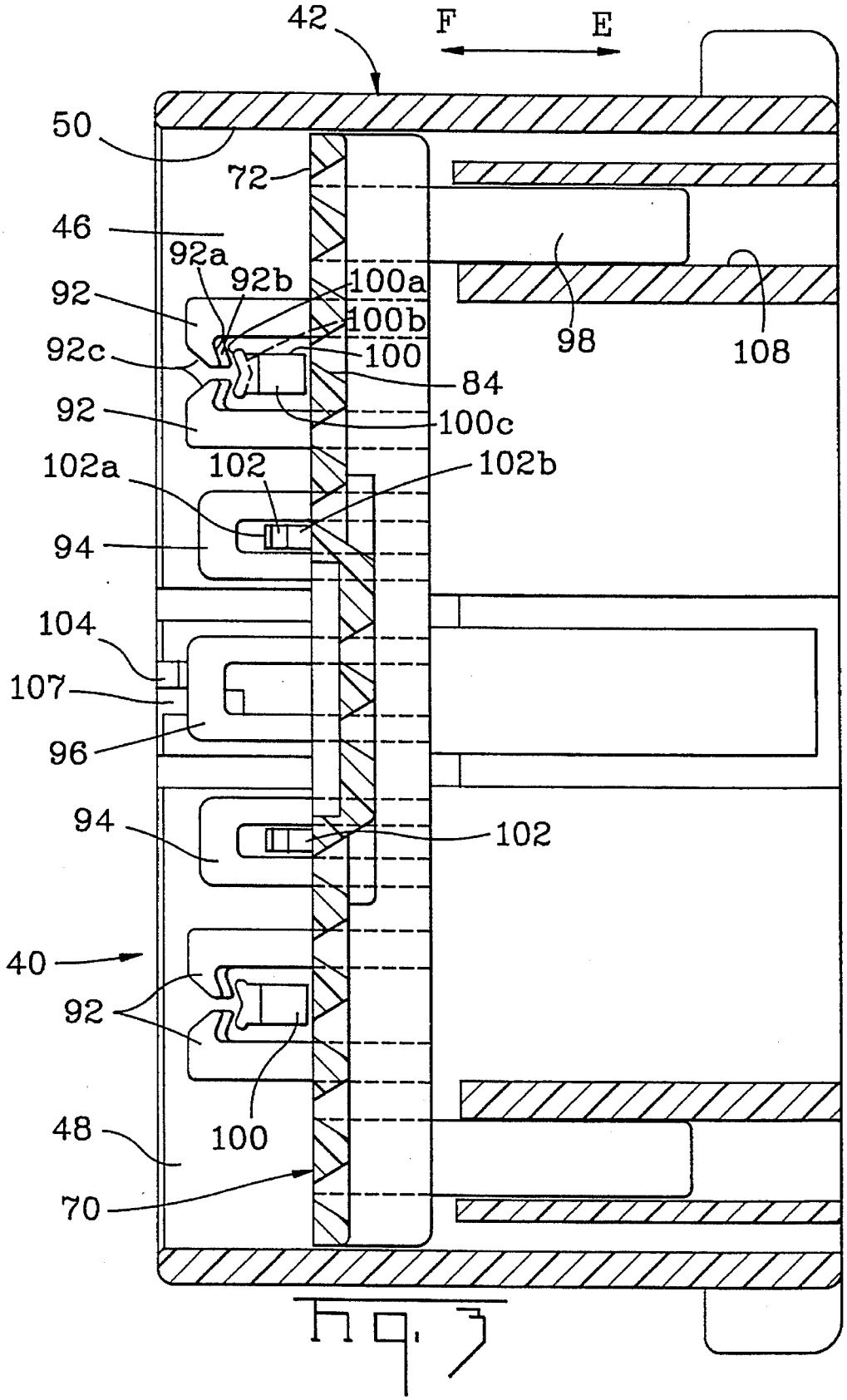
FIG. 3 is a cross sectional view of the female type connector having the guide member in FIG. 2.

The side plates 78 of the guide member 70 extend in the same direction from the opposed two edges 74, 76, thereby providing a generally U-shape in cross section defined by the guide plate portion 72 and two side plates 78, as best shown in FIG. 2B. This construction as well as the above mentioned ribs 90 help to enhance the mechanical strength of the guide plate portion 72 and to protect deflection and twist of the guide plate portion 72. Extending from the free end of each side plate 78 are a plurality of flexible arms 92, 94, 96 in the direction opposite to the direction to which the side plates 78 extend. Accordingly, each of the flexible arms 92, 94, 96 is in the form of a cantilever with the fixed end thereof mounted to the free end of the side plates 78 rather than extending directly from the edges 74, 78 of the guide plate portion 72. As compared with the arms 92, 94, 96 extending directly from the guide plate portion 72, the apparent length of the arms from the surface 80 of the guide plate portion 72 is shorter by the length of the side plates 78. This helps to reduce the possibility of deforming or breaking the arms 92, 94, 96 in the unmated condition of the female type connector 40 (FIG. 1) or in handling the guide member 70 individually (not assembled with the connector 40). Moreover, since the arms 92, 94, 96 are formed at the end portion of the side plates 78, there is no need to sacrifice the number of contact cavities and the arms are effectively protected by the sidewalls 48, 52 when accommodated in the insulating housing 42. Additionally, the arms 92, 94, 96 are coupled to the guide plate portion 72 by way of the side plates 78 having slight flexibility, thereby increasing the flexible length as compared with the arms extending directly from the guide plate portion 72, avoiding stress concentration to the arms 92, 94, 96 and also improving the durability of the arms 92, 94, 96. Guide posts 98 are integrally formed with the side plates 78 adjacent to both lateral ends thereof. The guide posts 98 help smooth movement of the guide member 70 without slanting thereof with respect to the direction to which the contact portions (not shown) of the tab contacts extend.

In the initial position of the guide member 70 as shown in FIG. 3, the leading ends of the U-shaped third arms 96 abut against projections 104 on the sidewalls 48, 52 of the insulating housing 42, thereby maintaining the guide member 70 within the insulating housing 42. Additionally, abutment of the inner portion 92*a* of a pair of generally L-shaped first arms 92 against the leading end portions 100*a* of first projections 100 on the sidewalls 48, 52 prevents the guide member 70 from moving within (downwardly in FIG. 3) the recess 46. The first arms 92 are formed with sloped surfaces 92*b* at the inner portions 92*a* to abut against a respective sloped surface 100*b* at the leading end portions 100*a* of the first projections 100, thereby preventing the first arms 92 from deflecting in the direction away from the sidewalls 48, 52 on the insulating housing 42. The direction to which the inner portions 92*a* of the first arms 92 extends is not orthogonal to the surface of the sidewall 50, rather slightly slanted relative to the front panel 72. Also, the leading end portions 100*a* of the first projection 100 are slanted similarly. The slanted inner portions 92*a* and the leading end portions 100*a* maintain the engagement with the first projections 100 unless the outer end portions 92*c* of the first arms 92 engage the generally diamond shaped projections 32 of the male type connector 10 (FIG. 1).

As the male type connector 10 passes into the recess 46 in the female type connector 40, a pair of first arms 92 spread by the engagement between the generally diamond-shaped projections 32 and the outer portions 92*c* of the first arms 92 to disengage the first arms 92 from the first projections 100. Simultaneously, the engagement between the projections 34 on side surfaces 20, 22 of the male type connector 10 and the projections within the grooves 105 inside of the sidewalls 50, 54 of the female type connector 40 provides temporary retention of the both connectors 10, 40. In temporary retention of the both connectors 10, 40, inertia of the guide member 70 abutting against the entering female type connector 40 may move only the guide member 70 to the receded position prior to normal mating of the tab contacts (not shown) in the male type connector 10 with the receptacle (or female) contacts. In this circumstance, the tab contacts are not fully supported and guided due to engagement of the receptacle contacts of the mating face 16 of the male type connector. In order to avoid this, the generally U-shaped second arms 94 of the guide member 70 abut against tapered surface 102*a* of the second projections 102 on the sidewalls 48, 52 thereby preventing the guide member 70 from moving individually. That is, when the first arms 92 and the first projections 100 are disengaged by the generally diamond-shaped projections 32 of the male type connector 10, the guide member 70 slightly recedes or moves in the direction of the arrow E in FIG. 3 and is temporarily stopped by the abutment of the second arms 94 against the tapered surfaces 102*a* of the second projections 102. Subsequently, as the male type connector 10 proceeds against the engagement between the second arms 94 and the second projections 102 by operating the bolt 110 relative to the nut (not shown), the second arms 94 override the second projections 102 to enable the guide member 70 to move to the most remote position in the recess 46. The movement of the guide member 70 from the initial position to the remote position is smooth due to the sliding engagement between the arms 92, 94, 96 and the sidewalls 48, 52 and the mating of the guide posts 98 with the post guiding portions 108 of the female type connector 40. In the temporary retention condition of the both connectors 10, 40, the first arms 92 override the generally diamond-shaped projections 32 of the male type connector 10 to engage with the sloped surfaces 32*a* thereof (FIG. 1), thereby enabling the guide member 70 to advance (in the direction of the arrow F in FIG. 3) when the male type connector 10 is removed as described hereinafter.

When the bolt 110 is rotated in the reverse direction to unmate the male type connector 10 from the female type connector 40, the guide member 70 moves outward to follow the male type connector 10 by the engagement between the first arms 92 and the respective projections 32. It is to be noted here that the guide member 70 can move outward relatively easily because the first arms 92 and the second arms 94 engage respectively with relatively slopes 100*c* and 102*b* of the first and second projections 100, 102 so as to override the first and the second projections 100, 102. When the guide member 70 reaches the initial position as shown in FIG. 3, the guide member 70 is prohibited to move further by the abutment of the third arms 96 against the third projections 104, thereby disengaging the first arms 92 from the projections 32 in the male type connector 10 and enabling separation of the male type connector 10 from the female type connector 40. Such cooperation of a plurality of arms and projections enables the guide member 70 to be retained at the initial position, to move outward and to stop from pull-out. It is to be noted that the guide member 70 can be removed easily from the female type connector 40 by forming tool access grooves 97, 107 at the locations adjacent to the leading ends of the third arms 96 and the third projections 104.

Figure 4:
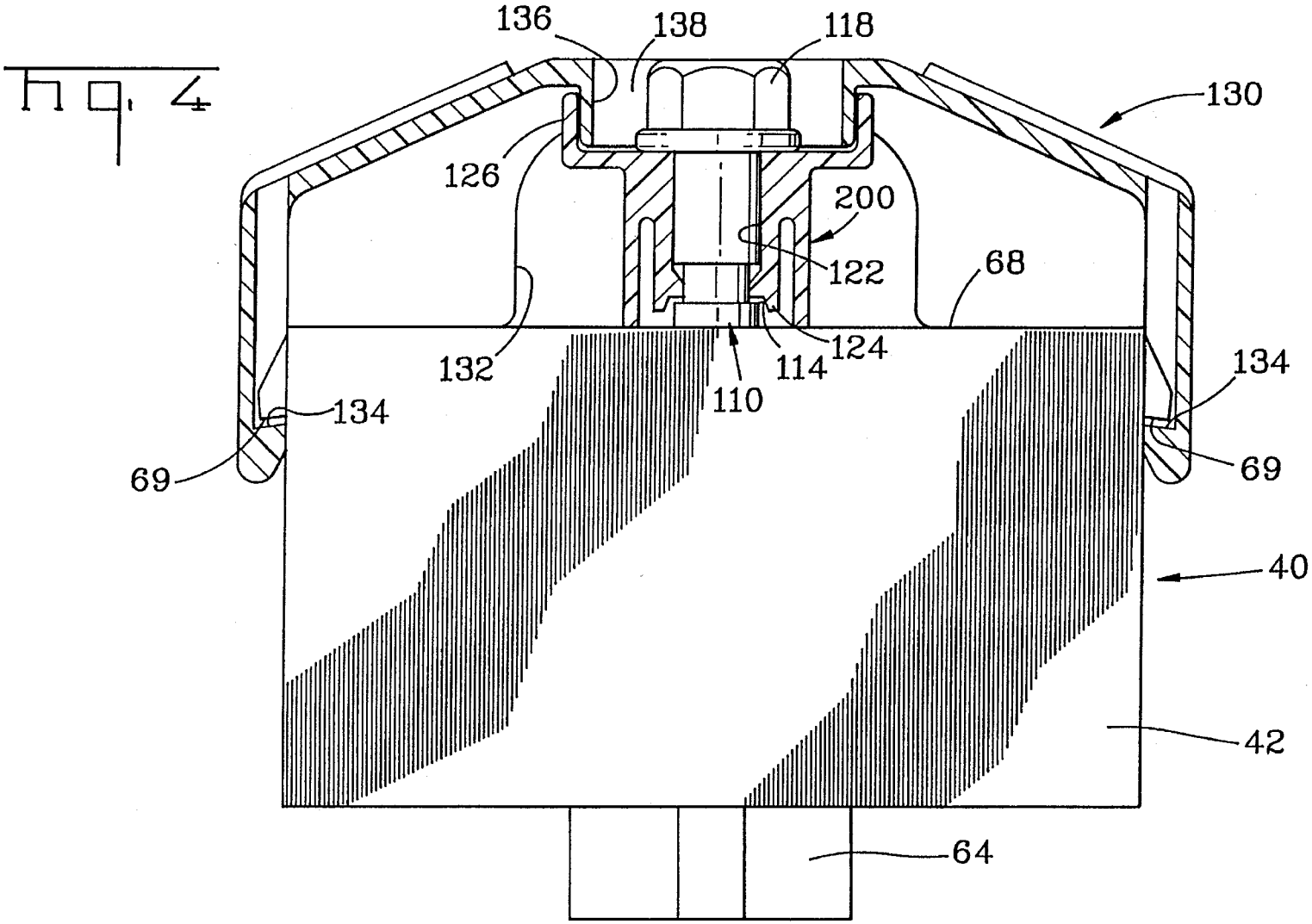
FIG. 4 is a partial cross sectional view of the assembled female type connector.

Illustrated in FIG. 4 is a partial cross section view of the assembled female type connector. By reference to FIGS. 1 and 4, the female type connector 40 further comprises a bolt retention housing 120 and also a wire cover 130, if desired. The bolt retention housing 120 retains the bolt 110 in its passageway 122 by the engagement between resilient arms 124 and a first step portion (or shoulder) 114 of the bolt 110. The bolt 110 is inserted into a bolt receiving hole (not shown) in communication with the opening 64*a* (FIG. 1) in the sleeve portion 64 of the female type connector housing 42. The bolt 110 and the bolt retention housing 120 are mounted on the housing 42 by engaging a metal fixture (not shown) buried in the housing 42 with a second step portion 116 of the bolt 110. The bolt retention housing 120 is formed with a known separate indicator 125 to prevent the screw portion 112 of the bolt 110 and the housings 12, 42 from being broken due to excessive rotation or fastening of the bolt 110.

The wire cover 130 is used to extend wires (not shown) from the wire insertion face 68 of the female type connector housing 42 in the predetermined direction. The wire cover 130 is provided with four latching members 134 to be clamped onto the female type connector housing 42 by means of engagement with four engaging projections 69 (only two projections are shown in FIG. 4) at the side surfaces 56, 58 of the female type connector housing 42. The wire cover 130 is also formed with a downward cylindrical portion 136 at substantially the center position thereof. The cylindrical portion 136 has a diameter to overlap with the cylindrical flange 126 of the bolt retention housing 120 when the wire cover 130 is mounted on the female type connector housing 42. The overlapping of the cylindrical portion 136 and the cylindrical flange 126 helps to keep any wires (not shown) from the wire insertion face 68 away from the opening 138 of the cylindrical portion 136. In this way, an impact wrench or other tool (not shown) to rotate the head portion 118 of the bolt 110 is effectively protected from entangling wires.

Now, another embodiment of the connector having guide member will be described hereunder by reference to FIGS. 5 through 15. FIGS. 5 through 11 show the outline of the plug housing and a cross sectional view of the guide member to explain the process of mating of the connector.

Figure 5:
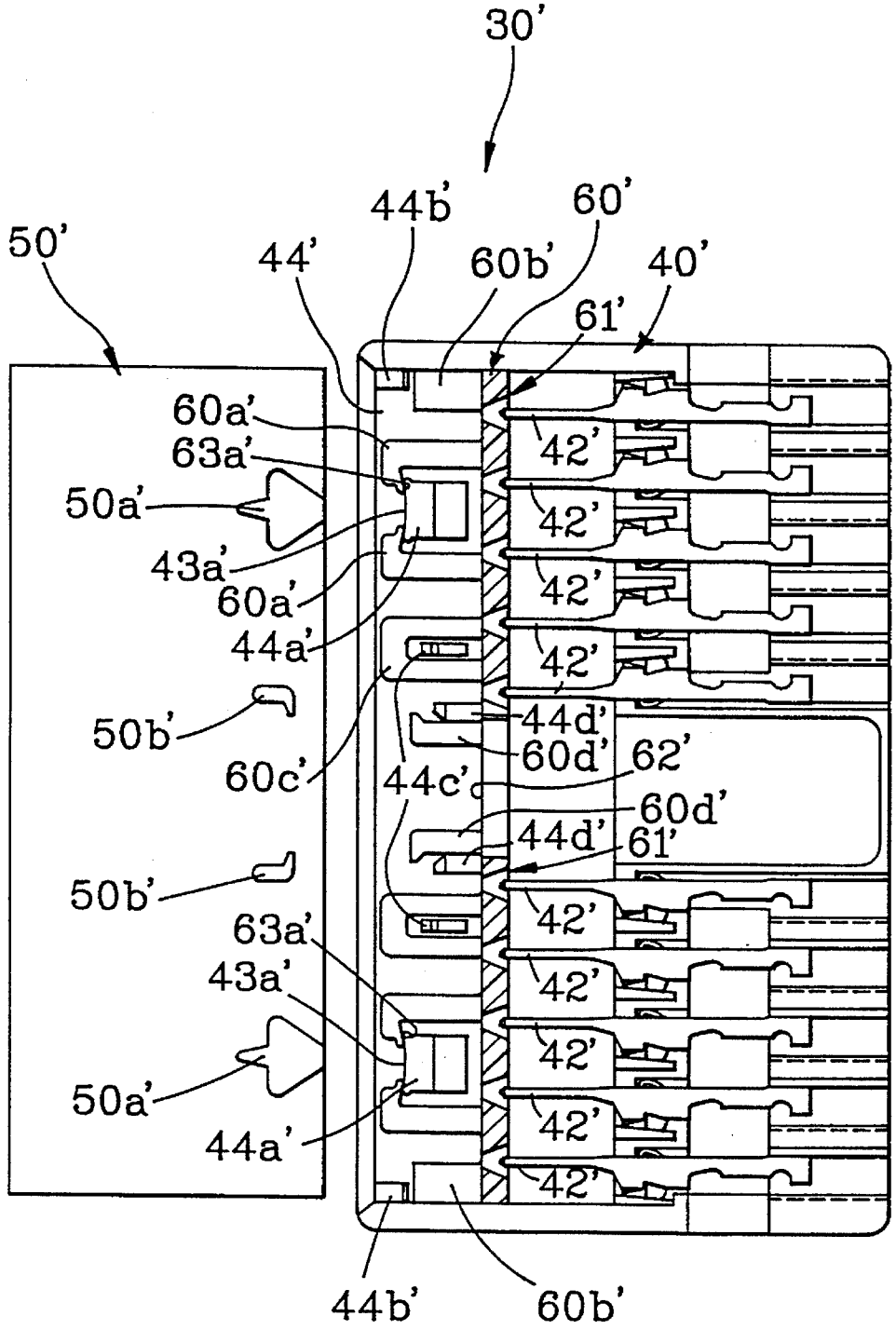
FIG. 5 is a cross sectional view before mating of the cap and plug housings and the guide member according to another embodiment of the connector.

Firstly, a reference is made to FIG. 5 to describe the construction of the connector having a guide member. The connector 30' having guide member comprises a cap housing 40' and a plug housing 50' to be mated with each other. There are a plurality of male contacts 42' in the cap housing 40'. Also accommodated in the cap housing 40 is a plate-like guide member 60' which is substantially parallel to the mating face of the cap housing 40'. Formed in the guide member 60' is a plurality of through holes 61' through which a plurality of male contacts 42' extend.

A pair of projections 44*a*' having surfaces 43*a*' substantially orthogonal to the mating direction are formed on a bottom wall 44' of the cap housing 40' so that the projections 44*a*' engage a pair of L-shaped legs 60*a*' formed on the guide member 60' to have the faces 63*a*' perpendicular to the mating direction. Such engagement is established by the abutment of the two faces 43*a*', 63*a*' which are substantially orthogonal to the mating direction, thereby preventing accidental movement of the guide member 60' toward the rear ends of the male contacts 42' by vibration or other force. There is formed a downward slope on the upper face of the projection 44*a*' from the center to the rear portions, thereby providing easy removal of the connector. Also, there are formed two projections 44*b*' on the bottom wall 44' of the cap housing 40' so that stopper legs 60*b*' of the guide member 60' abut against the projections 44*b*' to prevent the guide member 60' from dropping out of the cap housing 40'. Additionally, the cap housing 40' is provided with two projections 44*c*' on the bottom wall to have downward slopes on the upper surface from the center portion to forward and backward directions. Also, the projections 44*c*' temporarily stop the guide member 60' until the plug housing 50' abuts against a reference face 62' of the guide member 60' by the plug housing 50' engaging temporary stop legs 60*c*' of the guide member 60' when it is slightly mated with the cap housing 40'. This arrangement is effective to avoid engagement between the male contacts 42' in the cap housing 40' and the female contacts (not shown) in the plug housing 50', thereby ensuring reliable engagement between contacts. Additionally, there are two projections 44*d*' on the bottom wall of the cap housing 40' to deflect the L-shaped legs 60*d*' as described further in detail. Note that projections 44*a*' through 44*d*' (not shown) are also formed on the upper wall of the cap housing 40'.

Also, the plug housing 50' is formed with wedge projections 50*a*' to release the engagement between the L-shaped legs 60*a*' and the projections 44*a*' by moving between the L-shaped legs 60*a*' to deflect them away from each other. Furthermore, projections 50*b*' are formed for smoother movement of the guide member 60' when the male contacts 42' are slightly bent as described hereinafter.

Mating process of the connector 30' will be described. As best shown in FIG. 5, under unmated condition of the cap housing 40' and the plug housing 50', the projections 44*a*' and the L-shaped legs 60*a*' are firmly engaged in the direction of the rear end of the male contacts 42' by positive abutment between the faces 43*a*' of the projections 44*a*' of the cap housing 40' and the faces 63*a*' of the L-shaped legs 60*a*'. This avoids accidental movement of the guide member 60' toward the rear ends of the male contacts 42'. On the other hand, the stopper legs 60*b*' abut against the projections 44*b*' of the cap housing 40' to prevent the guide member 60' from dropping out of the cap housing 40'. Also, under the unmated condition of the cap housing 40' and the plug housing 50', the leading ends of the male contacts 42' are protected from external force because they do not extend out of the through-holes 61'.

Figure 6:
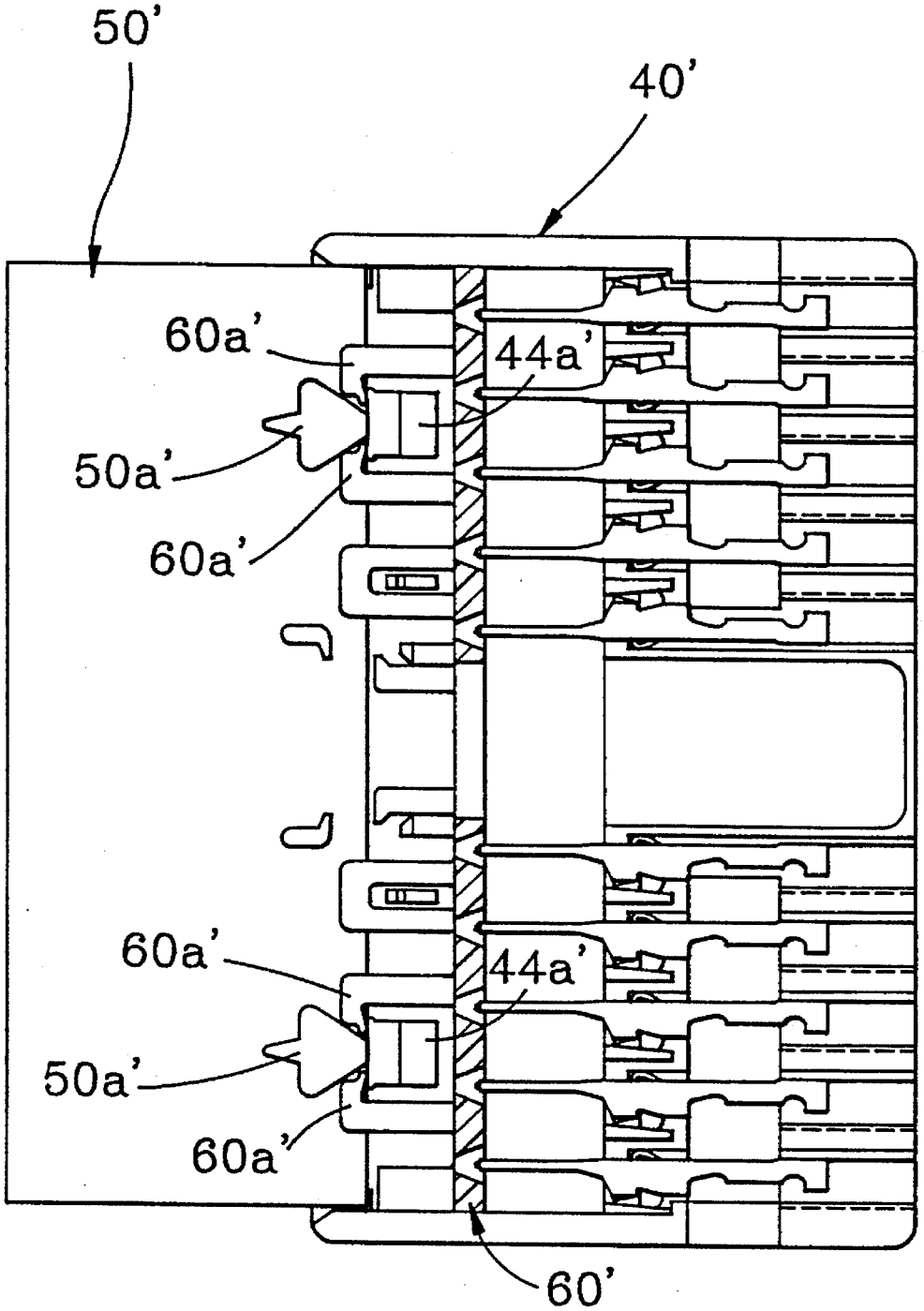
FIG. 6 is a cross sectional view of the cap and plug connector housings partially mated.
Figure 7:
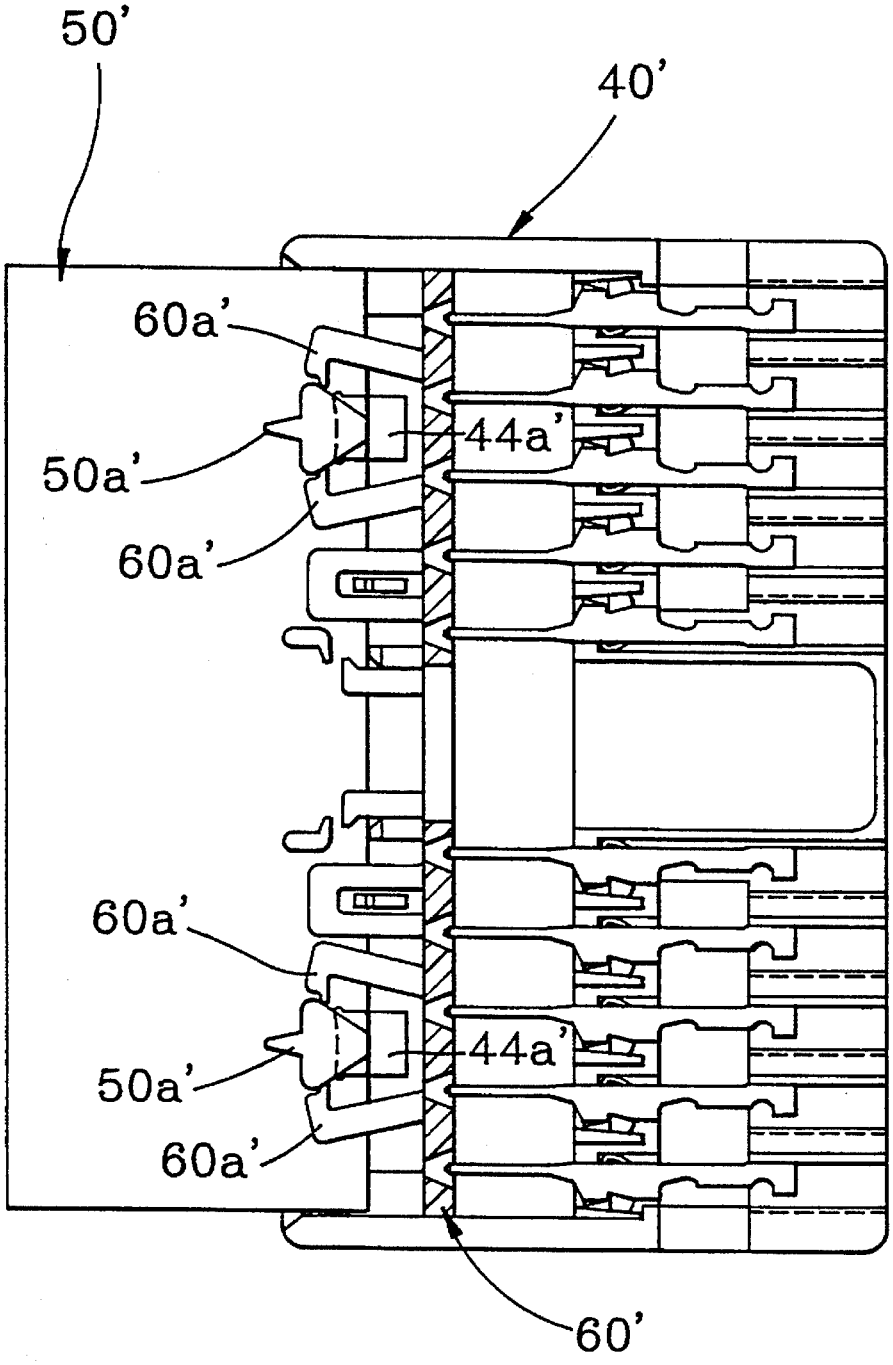
FIG. 7 is a cross sectional view of the connector further mated from FIG. 6.
Figure 8:
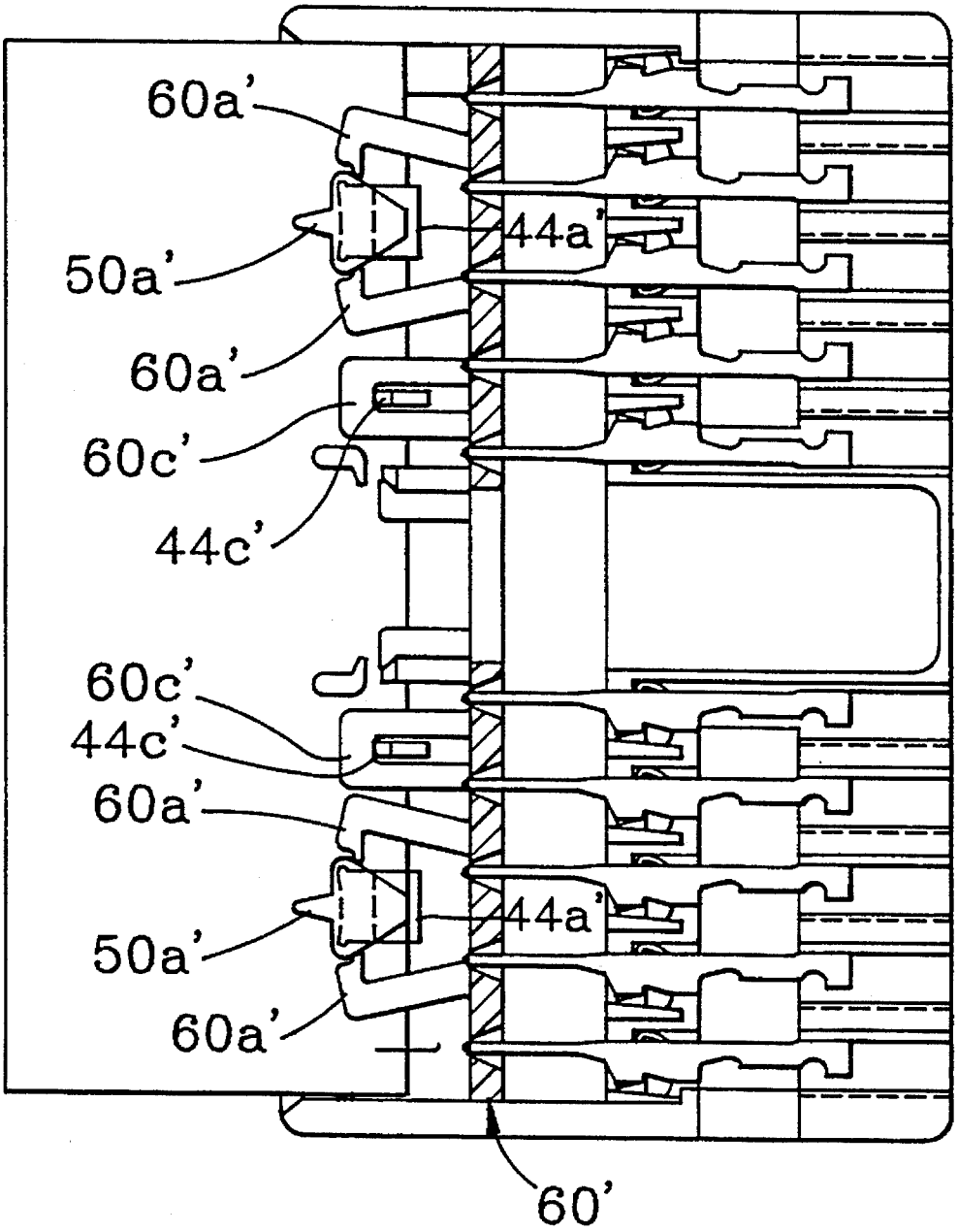
FIG. 8 is a cross sectional view of the connector mated further to the temporary stop position of the guide member.

As best shown in FIG. 6, when the cap housing 40' and the plug housing 50' are slightly mated to each other, the leading ends of the wedge projections 50*a*' move between a pair of L-shaped legs 60*a*'. When the cap housing 40' and the plug housing 50' are mated further, the wedge projections 50*a*' move deeper into the pair of L-shaped legs 60*a*' just above the projections 44*a*', thereby largely deflecting the pair of L-shaped legs 60*a*' away from each other as best shown in FIG. 7. When the cap housing 40' and the plug housing 50' are mated even further, engagement between the projections 44*a*' and the L-shaped legs 60*a*' is released and the guide member 60' stops temporarily by the engagement between the temporary stop legs 60*c*' and the projections 44*c*' as best shown in FIG. 8.

Figure 9:
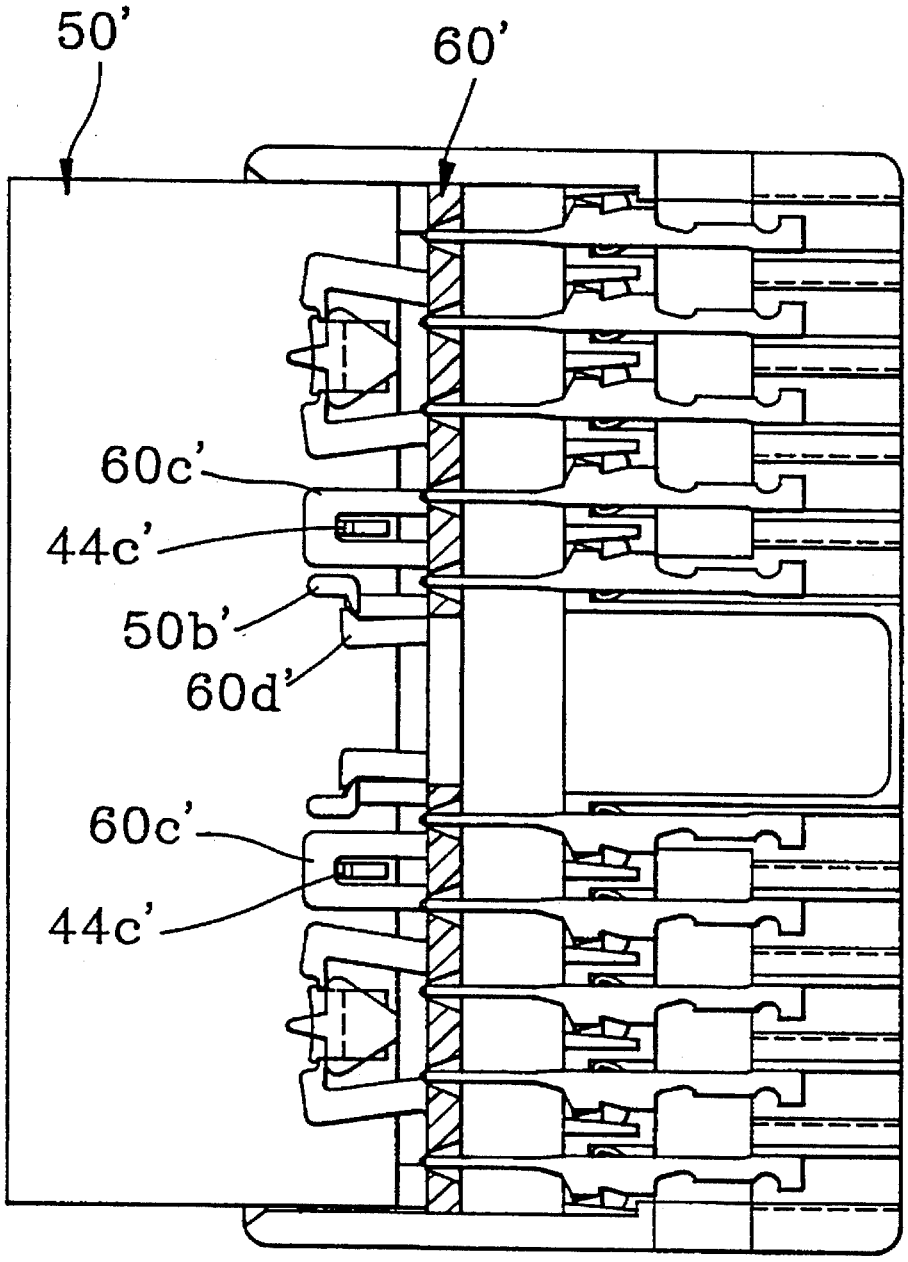
FIG. 9 is a cross sectional view of the connector mated further but the guide member still remains in the temporary stop position.
Figure 10:
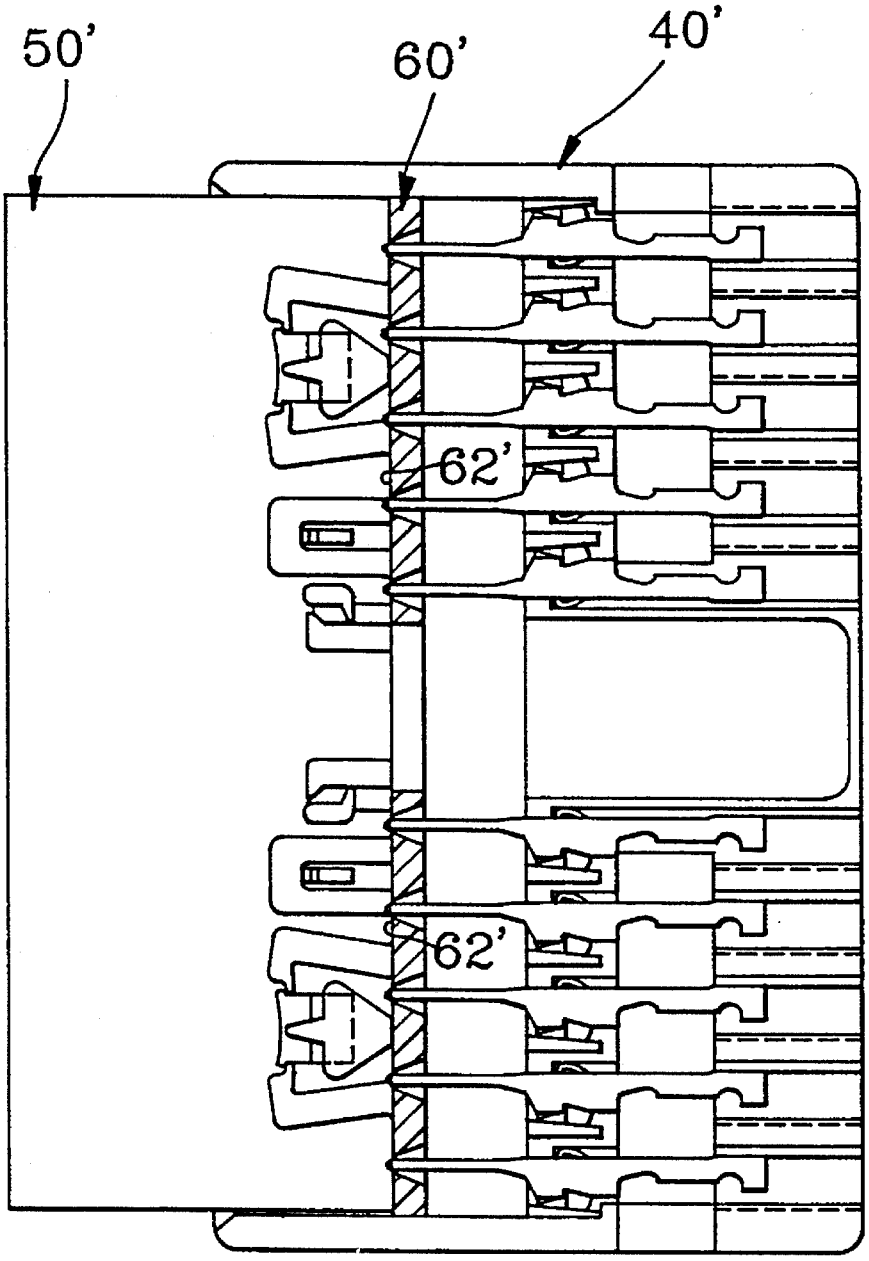
FIG. 10 is a cross sectional view of the connector with the plug connector abutting the guide member.
Figure 11:
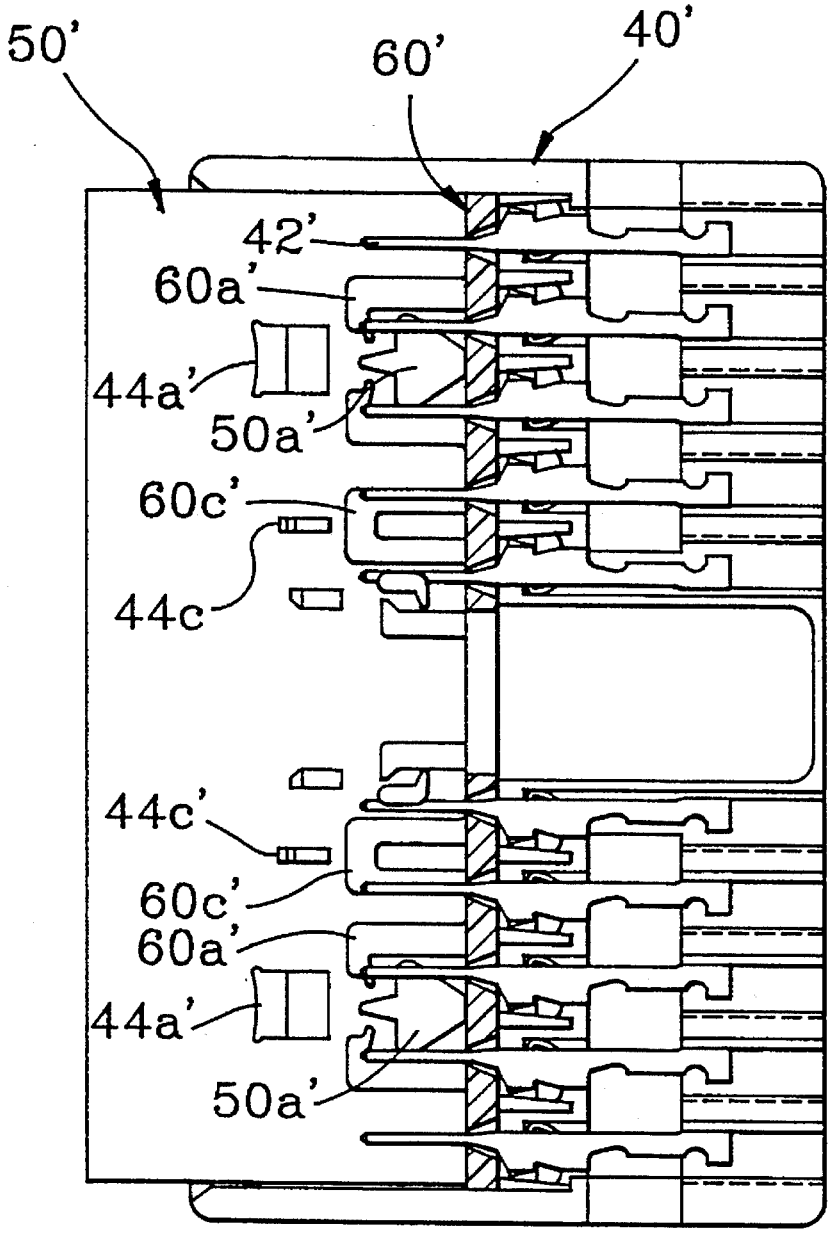
FIG. 11 is a cross sectional view of the completely mated connector.

Illustrated in FIG. 9 is the condition of further mating of the cap housing 40' and the plug housing 50' when the guide member 60' stops temporarily by the engagement between the temporary stop legs 60*c*' and the projections 44*c*' as the plug housing 50' approaches the guide member 60'. Further mating of the cap housing 40' and the plug housing 50' brings the plug housing 50' to abut against the base surface 62' of the guide member 60' as best shown in FIG. 10. It is this condition that the male contacts 42' start to engage the female contacts (not shown), thereby providing smooth engagement of the contacts avoiding collision of the male and female contacts. when mating operation continues while the plug housing 50' is abutting against the guide member 60', the temporary stop legs 60*c*' override the projections 44*c* to reach the complete mating between the male contacts 42' and the female contacts (not shown) as best shown in FIG. 11.

In order to unmate or disengage the male contacts 42' and the female contacts (not shown), the plug housing 50' is pulled in the (unmating) direction opposite to the mating direction. Then, the wedge projections 50*a*' engage with the pair of L-shaped legs 60*a*' to move the guide member 60' in the unmating direction. When the plug housing 50' is pulled further in the unmating direction, the pair of L-shaped legs 60*a*' override the projections 44*a*' and also the temporary stop legs 60*c*' override the projections 44*c*'. By pulling the plug housing 50 further, the projections 44*b* abut against the stopper legs 60*b*' to stop the movement of the guide member, thereby completely unmating or separating the plug housing 50' from the cap housing 40'.

Now, reference is made to FIGS. 12 through 15 to describe the mating process of the connector 40' in a circumstance where, for example, the male contacts 42' (see FIG. 5 are slightly bent so as not to hit the through-holes 61', thereby interfering with the smooth movement of the guide member 60'.

Figure 12:
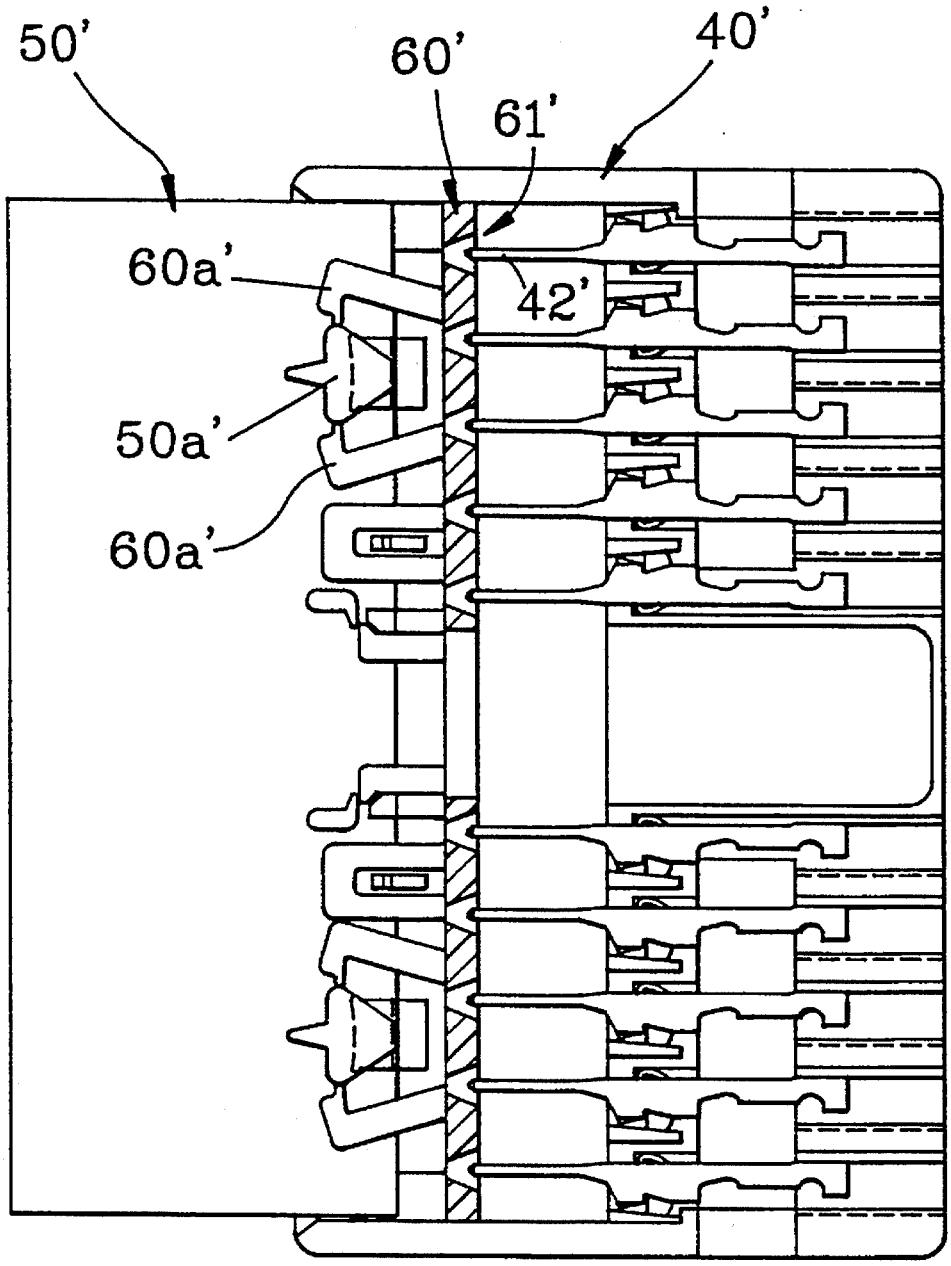
FIG. 12 is a cross sectional view of the connector in the process of mating when the guide member does not move smoothly.
Figure 13:
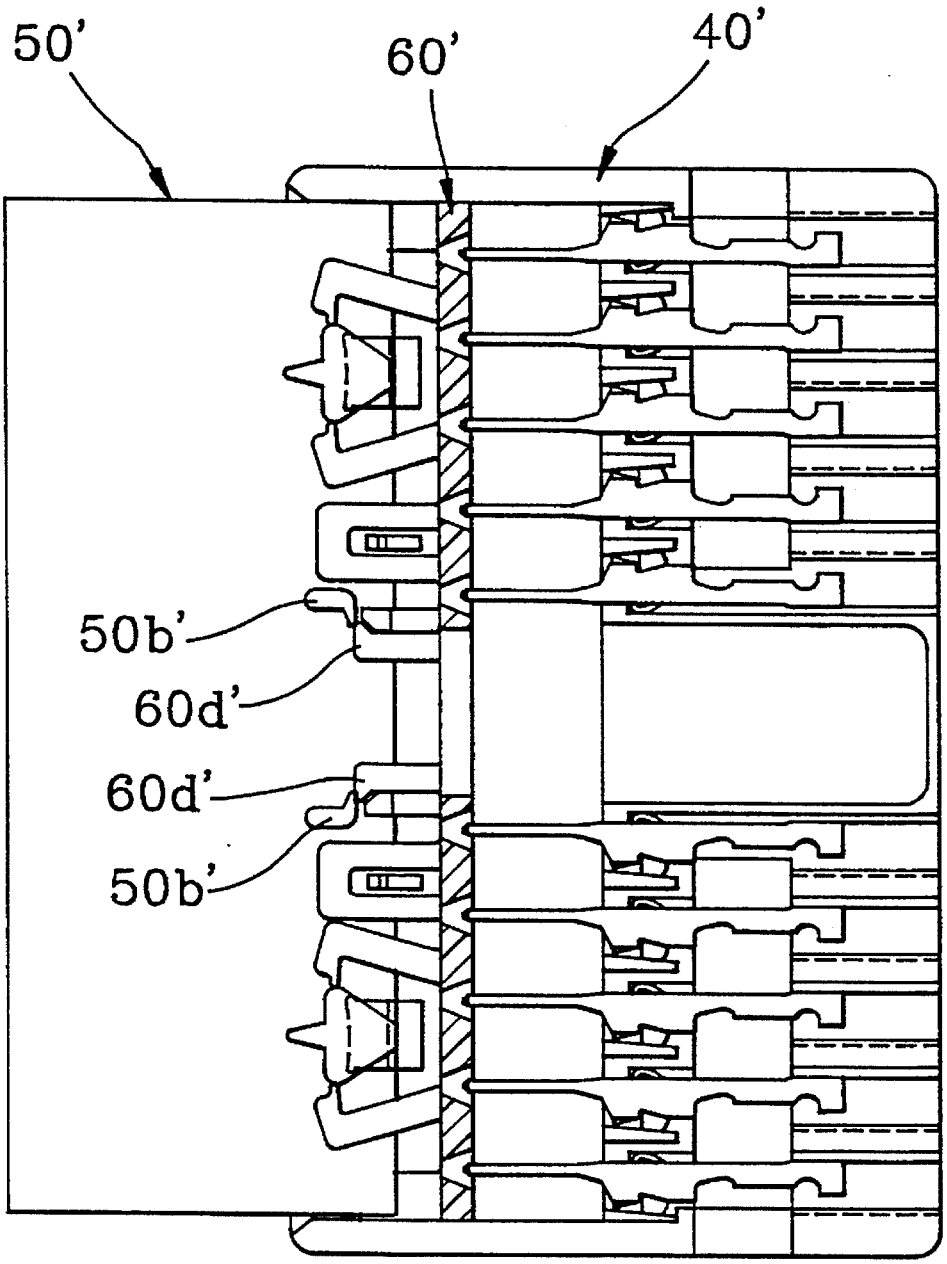
FIG. 13 is a cross sectional view of the connector mated further from the condition in FIG. 12.
Figure 14:
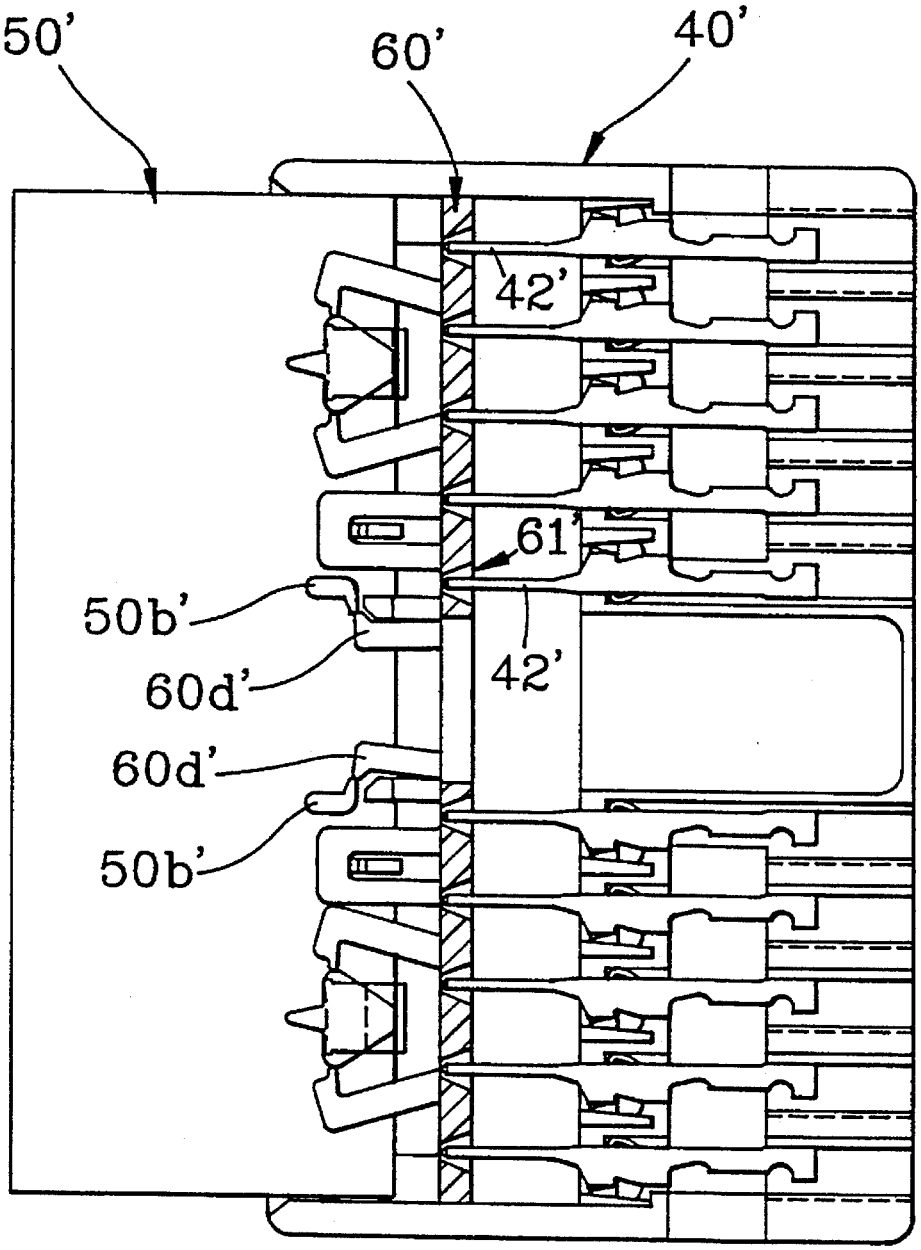
FIG. 14 is a cross sectional view of the further mated connector.
Figure 15:
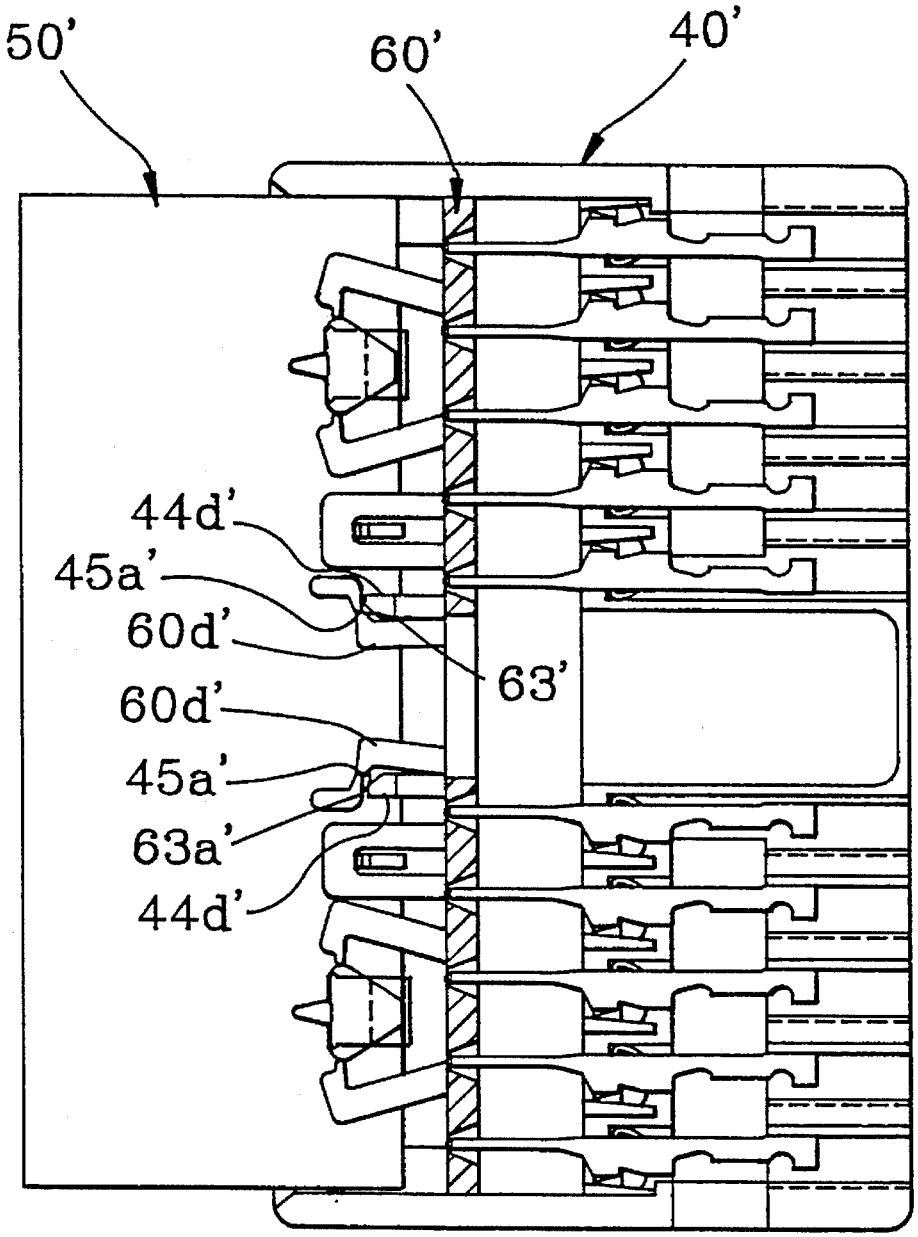
FIG. 15 is a cross sectional view of the completely mated connector.
Figure 16:
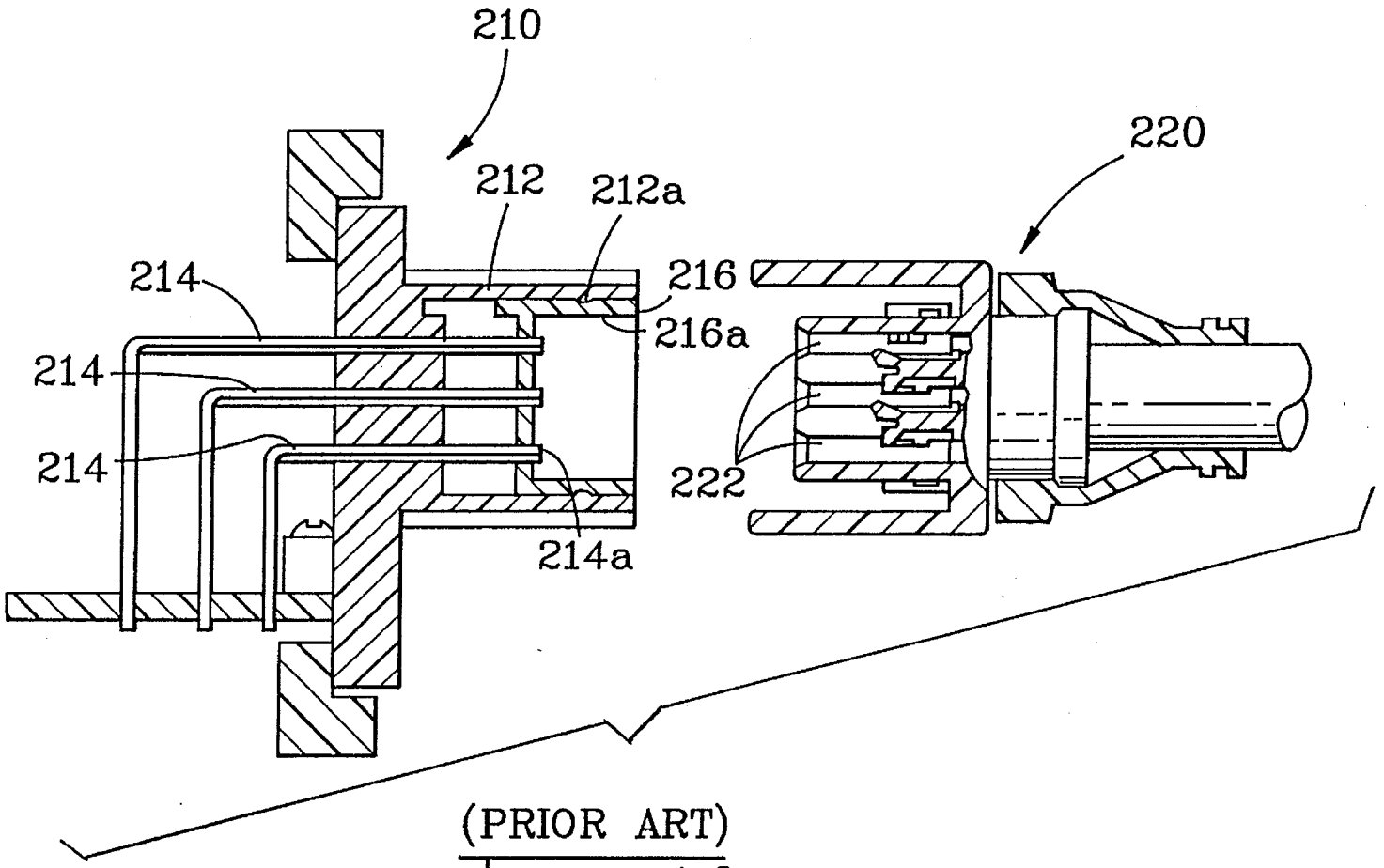
FIG. 16 is a cross sectional view of a conventional connector in an unmated condition.
Figure 17:
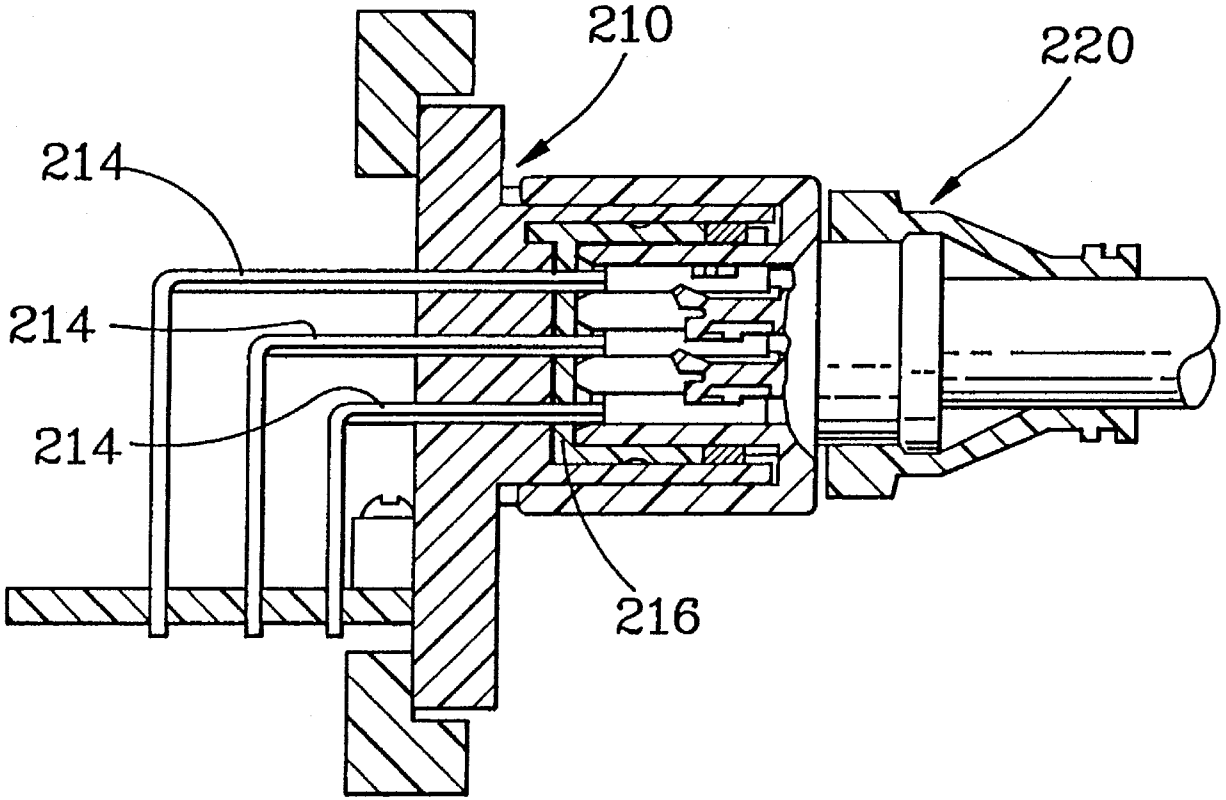
(PRIOR ART) FIG. 17
FIG. 17 is a cross sectional view of the fully mated conventional connector in FIG. 16.
Figure 18A:
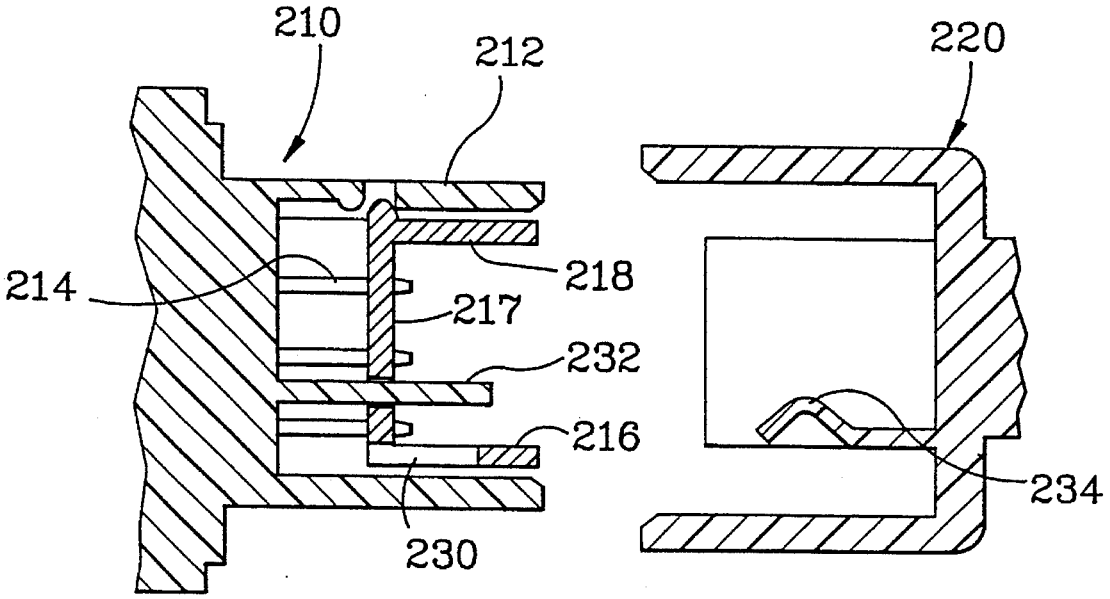
(PRIOR ART) FIG. 18A
FIG. 18A and 18B are cross sectional views of unmated and mated conventional connectors, respectively.
Figure 18B:
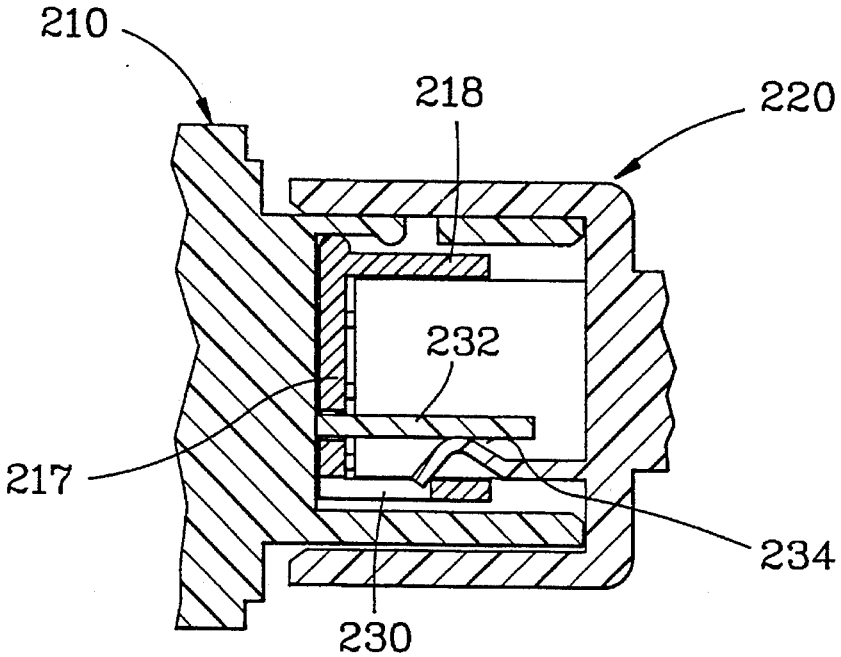
(PRIOR ART) FIG. 18B

Illustrated in FIG. 12 is a circumstance where the male contacts are slightly bent though not shown so as not to hit the through-holes 61' thereby interfering with the smooth movement of the guide member 60'. As apparent by comparing with FIG. 5, the plug housing 50' is mated slightly deeper in the cap housing 40' but the movement of the guide member 60' is limited. As best shown in FIG. 13, if the movement of the guide member 60' is limited, the projections 50*b*' abut against the L-shaped legs 60*d*' of the guide member 60' as the cap housing 40' is mated further with the plug housing 50'. When mated further, the L-shaped legs 60*d*' are pushed by the projections 50*b*' as best shown in FIG. 14, thereby slightly moving the guide member 60' in the mating direction and driving the leading ends of the male contacts 42' deeper into the through-holes 61'. As mating proceeds further, the sloped surfaces 63*a*' of the L-shaped legs 60*d*' are pushed substantially perpendicular to the mating direction by the slopes 45*a*' of the projections 44*d*' on the inner wall of the cap housing 40' as best shown in FIG. 15. This removes interference between the projections 50*b*' and the L-shaped legs 60*d*' as best shown in FIG. 13. The mating operation continues as shown in FIGS. 14 and 15 to complete the mating. This means that the connector 40, according to the present invention allows the guide member 60' to move smoothly to achieve proper mating even if the male contacts are slightly bent to hit the through-holes 61'.

It is to be understood that the legs 60*a*' may be T-shaped, J-shaped or any other shape rather than the L-shaped in the above preferred embodiments. Also, in the first embodiment, the first arms 92 may be modified to engage with recesses rather than the projections 32 in the male type connector 10.

The connector according to the present invention is suited for high contact density because the latching arms of the guide member do not interfere with the contacts. The latching arms extend with minimum length from the surface of the guide member by stemming from the opposite side of the side plates while providing sufficient resiliency, thereby minimizing the chance to deform or otherwise break the latching arms when the connector is unmated or when the guide member is handled separately. The guide member provides enhanced mechanical strength to twisting or deforming thereby improving the guiding operation.

Additionally, the connector with guide member according to the present invention provides improved protection of the guide member from accidental movement by vibration or other external force because of positive engagement by the legs of the guide member and the projections in the first housing. When mating the first and second housings, the engagement between the legs and the projections is easily released by the second housing which pushes the guide member for easy mating of the first and second housings.

We claim:

1. A connector having contact guide member comprising a first connector including a first housing and male contacts disposed in said housing to extend in a mating direction of said first connector, a second connector including a second housing to mate with said first housing, and a guide member in said first housing having through holes through which contact sections of said male contacts pass, said guide member being movable toward rear ends of said contact sections by being pushed by said second connector as said first and second connectors are mated together, characterized in that:

said first housing has projections formed on an inner wall thereof at a more forward position than front ends of said contact sections;

said guide member has legs formed with resilient spring members extending in the mating direction and hook members engaging said projections to prevent the movement of said guide member toward the rear ends of said contact sections; and said second housing having pushing projections unlatching the engagement between said legs and said projections by pushing said hook members during mating between said first and second housings.

2. A connector as claimed in claim 1, wherein said first housing includes other projections and said guide member has arms that engage said other projections for maintaining said guide member in said first housing.

3. A connector as claimed in claim 1, wherein said first housing includes further projections and said guide member has other arms that engage said further projections to temporarily maintain said guide member at an outer position.

4. A connector including a female insulating housing having a recess to receive a male connector therein and a guide member moveable in the recess in a mating direction of said male connector with said guide member having a guide plate portion having a plurality of openings to guide contact portions of male contacts extending into the recess and latching arms to engage with said male connector, characterized in that:

said guide member is provided with side plates extending into the mating direction from the edge portion of said guide plate portion; and said latching arms extend from the free ends of said side plates in the opposite direction to the direction in which said side plates extend.

5. A connector, comprising:

a first housing having first projections formed on an inner wall thereof;

a second housing to mate with the first housing and having pushing projections thereon;

male contacts disposed in said first housing and having contact sections and rear sections, the contacts being directed in a mating direction, first projections being at a more forward position than the contacts; and a guide member being disposed in the first housing and being movable during mating and unmating of the first and second housing, the guide member having a guide plate with through holes to guide the contact sections during mating of the first and second housing, the guide member having resilient legs and hook members which engage the first projections and prevent the guide member from moving until mating of the first and second housings occurs;

whereby during mating of the first and the second housings, the pushing projection unlatches the engagement between the first projection and the legs and pushes the guide member towards the rear section of the contacts while the contact sections are guided through the through holes on the guide plate, during unmating of the first and the second housings, the pushing projection pulls the guide member towards the contact sections so as to leave the contacts protected when completely unmated.

6. The connector of claim 5, wherein first of said legs are L-shaped, second and third of said legs are U-shaped.

7. The connector of claim 6, wherein said first legs engage said projections to prevent movement of the guide member toward the rear ends of said male contact sections.

8. The connector of claim 7, wherein the pushing projection is diamond shaped, and wherein during mating of the housings, the pushing projection pushes said fist legs out of engagement with the first legs and then the pushing projection engages the first legs in order to both push the guide member into the first housing and past the contact sections of the male contacts, and also to pull the guide member towards a mating face of the first housing during unmating of the connector.

9. The connector of claim 8, wherein the first housing has a second projection which engages the second legs and prevents the guide member from moving past the contact sections of the male contacts during mating while the pushing projection is disengaging the first arm from the first projection.

10. The connector of claim 5, wherein first of said legs are L-shaped, second of said legs are U-shaped, and third of said legs are L-shaped.

11. The connector of claim 10, wherein during mating of said first and said second housing, said third legs having portions which are pushed substantially perpendicular to the guide plate by a third projection, thereby pushing the guide member past the contact sections smoothly in the event the contact sections are bent.

12. The connector of claim 5, wherein the guide member comprises a guide plate with the through holes, said guide plate having side plates which extend from edges of said guide plate, towards the rear ends of said male contacts, said legs extending from said side plates, beyond said guide plate in the mating direction.

13. The connector of claim 5, wherein the first and the second housings are drawn together into a mated position by action of a bolt.

14. The connector of claim 13, wherein the fist housing has a sleeve to receive the bolt therethrough, the guide member has an opening through which the sleeve extends.

* * * * *